US012504022B1

(12) United States Patent
Shi et al.

(10) Patent No.: US 12,504,022 B1
(45) Date of Patent: Dec. 23, 2025

(54) CEILING FAN WITH A BLADE QUICK CONNECTION

(71) Applicant: Hunter Fan Company, Memphis, TN (US)

(72) Inventors: Xin Shi, Zhongshan (CN); Huahai Wu, Guangdong Province (CN); Yongle Chen, Guangdong Province (CN); Mengdong Dong, Guangdong Province (CN); Linjjun Xu, Guangdong Province (CN); Binghui Guo, Guangdong Province (CN); Tian Zhou, Guangdong Province (CN)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 19/177,204

(22) Filed: Apr. 11, 2025

(30) Foreign Application Priority Data

Apr. 3, 2025 (CN) ..... 202510421301.X

(51) Int. Cl.
*F04D 29/34* (2006.01)
*F04D 25/08* (2006.01)
*F04D 29/64* (2006.01)

(52) U.S. Cl.
CPC ..... *F04D 29/34* (2013.01); *F04D 25/088* (2013.01); *F04D 29/644* (2013.01)

(58) Field of Classification Search
CPC ..... F04D 25/088; F04D 29/34; F04D 29/644
See application file for complete search history.

(56) References Cited

U.S. PATENT DOCUMENTS

| | | | | | |
|---|---|---|---|---|---|
| 5,980,353 | A * | 11/1999 | Wu | F04D 25/088 | 416/207 |
| 6,059,531 | A * | 5/2000 | Tai | F04D 29/34 | 416/207 |
| 6,699,014 | B1 | 3/2004 | Lam | | |
| 6,857,854 | B2 | 2/2005 | Pearce | | |
| 8,047,795 | B2 | 11/2011 | Pearce | | |
| 8,668,451 | B2 | 3/2014 | Haynes | | |
| 9,039,377 | B2 | 5/2015 | Lagman | | |
| 2002/0054816 | A1* | 5/2002 | Bucher | F04D 25/088 | 416/210 R |
| 2004/0013527 | A1* | 1/2004 | Pearce | F04D 25/088 | 416/210 R |
| 2008/0175710 | A1* | 7/2008 | Pearce | F04D 25/088 | 416/136 |

* cited by examiner

*Primary Examiner* — Nathaniel E Wiehe
*Assistant Examiner* — Aye S Htay
(74) *Attorney, Agent, or Firm* — McGarry Bair PC; Mark A. Davis

(57) ABSTRACT

A ceiling fan assembly or similar air-moving device can include a motor for rotating one or more blades to drive a volume of air about a space. A blade iron can couple the blades to the rotor. A blade iron mount provides for connecting the blade iron to the rotor by having a pair of spaced slots aligning with a complimentary pair of studs. The pair of spaced slots receive the pair of studs at a first position and the pair of studs can slide from the first position to a second position in the pair of spaced slots to secure the blade iron to the rotor.

20 Claims, 8 Drawing Sheets

CEILING FAN WITH A BLADE QUICK CONNECTION

CROSS-REFERENCE TO RELATED APPLICATION

This application claims the benefit of Chinese Application No. 202510421301X, filed Apr. 3, 2025, which is incorporated herein by reference in its entirety.

TECHNICAL FIELD

This disclosure is directed to a ceiling fan, and more specifically, to a ceiling fan having a quick connection with a blade or blade iron.

BACKGROUND

Ceiling fans are traditionally suspended from a structure for moving a volume of air about an area. The ceiling fan includes multiple parts, such as assemblies, components, and/or elements, that must be coupled to each other as part of the installation of the ceiling fan. The assembling of the multiple parts has traditionally been accomplished with traditional tools, fasteners, and the like, which is easily handled by an experienced installer, but can be challenging for an inexperienced installer.

BRIEF DESCRIPTION

In one aspect, the disclosure relates to a ceiling fan comprising: a motor having a rotor; a blade iron mount carried by the rotor and having a pair of spaced slots and a latch spring; a blade iron having a pair of studs, complementary to the spaced slots, and a strike partially defining a spring catch recess; wherein the latch spring, spring catch recess, and strike are arranged such that, after the studs are located in the slots, a radial outer movement of the blade iron deflects the latch spring over the strike, where the latch spring deflects into the spring catch recess and the strike prevents radial inner movement of the blade iron.

In another aspect, the disclosure relates to a ceiling fan comprising: a motor having a rotor; a blade iron mount comprising a bracket, mounted to the rotor, with radially arranged sets of a pair of spaced slots and a latch spring; a blade iron having a pair of studs, with a shank terminating in a head, complementary to the spaced slots, and a strike partially defining a spring catch recess; wherein the latch spring, spring catch recess, and strike are arranged such that after the shanks are located in the spaced slots, a radial outer movement of the blade iron deflects the latch spring over the strike, where the latch spring deflects into the spring catch recess and the strike prevents radial inner movement of the blade iron.

DETAILED DESCRIPTION

Figure 1:
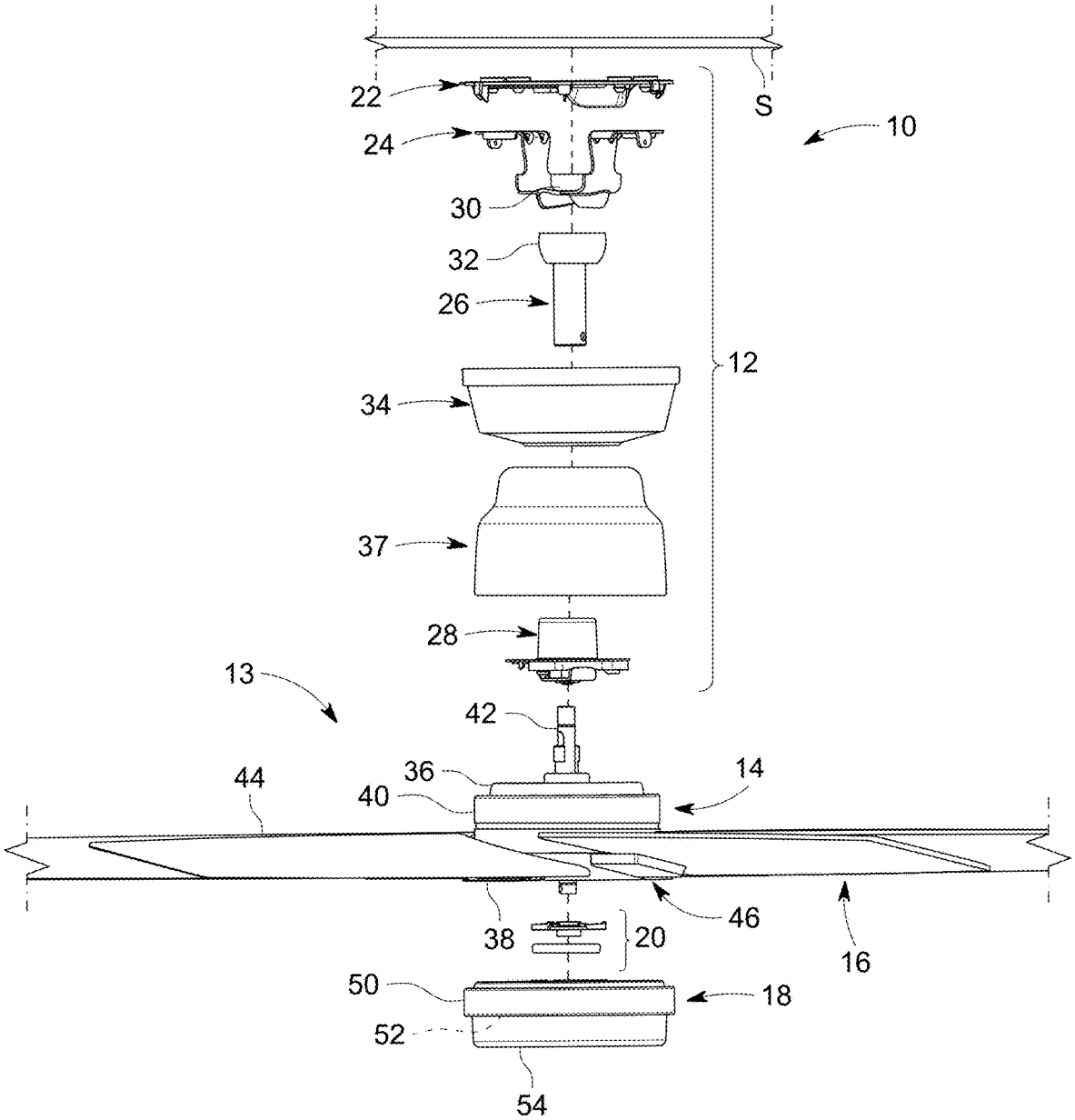
FIG. 1 is an exploded view of a ceiling fan assembly having major elements such as a motor assembly, mounting assembly, light assembly, blades and quick connect blade system.

The disclosure is related to a ceiling fan assembly, a corresponding kit, along with the components forming the assembly or kit. The resulting ceiling fan can be used, for example, in residential and commercial applications. Such applications can be indoors, outdoors, or both. While this description is primarily directed toward a residential ceiling fan, it is also applicable to any environment utilizing fans or for cooling areas utilizing air movement.

As used herein, the term "set" or a "set" of elements can be any number of elements, including only one. All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

Referring now to FIG. 1, a ceiling fan assembly 10 is illustrated as being capable of suspension from a structure S. The structure S can be a ceiling. However, it should be understood that the structure S is schematically shown and is by way of example only, and can include any suitable building, structure S, home, business, or other environment wherein moving air with a ceiling fan is suitable or desirable.

The ceiling fan assembly 10 includes a mounting assembly 12 and a ceiling fan 13 having a motor assembly 14, a blade set 16, and a light assembly 18. A connection assembly 20 can be used to secure together any of the mounting assembly 12, motor assembly 14, or light assembly 18, including components within each of the assemblies. While only one connection assembly is shown and described, multiple connection assemblies can be used to secure together multiple assemblies or components.

The mounting assembly 12 can include a mounting bracket 22, a hanger bracket 24, a downrod 26, and a motor adapter 28. The mounting bracket 22 is typically the primary coupling with the structure S. The hanger bracket 24 couples the downrod 26 to the mounting bracket 22 and can be physically integrated with the mounting bracket 22 or mechanically secured to the mounting bracket 22. The hanger bracket 24 can include a ball seat 30 and the downrod 26 can include a ball 32 that is received within the ball seat 30 to secure the downrod 26 to the hanger bracket 24 while permitting pivotal movement of the downrod 26 relative to the hanger bracket 24. The motor adapter 28 can be provided to secure the downrod 26 to the motor assembly 14, which provides an indirect mounting of the downrod 26 to the motor assembly 14 as compared to a direct mounting. A canopy 34 can be provided with the mounting assembly 12 to visually hide the mounting bracket 22 and the hanger bracket 24.

The motor assembly 14 can include a motor 36, which is enclosed, fully or partially, by a motor housing 37. The motor 36 comprises a rotor 38, stator 40, and a motor shaft 42. As illustrated the motor 36 is an external rotor motor, where the rotor 38 circumscribes the stator 40, and the stator 40 is affixed to the motor shaft 42, which is non-rotating. Since the motor shaft 42 is non-rotating, the rotor 38 is rotationally coupled to the non-rotating motor shaft 42, such as by the use of one or more bearing assemblies (not shown). While not shown in the drawings, it is contemplated that the motor 36 could be an internal rotor motor, wherein the rotor is secured to the motor shaft, which rotates with the rotor. Since the internal rotor has a rotating motor shaft, the stator can be connected to the rotating motor shaft by one or more bearing assemblies.

The blade set 16 can have one or more blades 44, which will be connected to the rotor 38 by using a quick connect blade system 46. In the case of an internal rotor motor, the blades 44 can be connected by a blade iron 58 or similar structure connected to either the rotor 38 or the rotating motor shaft 42.

The light assembly 18 can include a light housing 50 that carries an illumination source 52, such as an LED light or LED array. Other illumination sources, like traditional light bulbs may also be used instead of or in combination with the LED light source. A globe 54 can be affixed to the light housing 50 and covers the illumination source 52 for aesthetic purposes. The globe 54 can be made of any suitable material, such as glass or plastic, and have any suitable degree of transparency. The light housing 50 can also enclose mechanical or digital switches for turning on/off/dimming of the illumination source 52 and/or controlling the on/off/speed of the motor 36. Thus, the light housing 50 can also be referred to as a switch housing, especially when an illumination source 52 is not included. In a variation where the illumination source 52 is not included, a cover (not shown), including an opaque cover, can be used instead of the globe 54.

Figure 2:
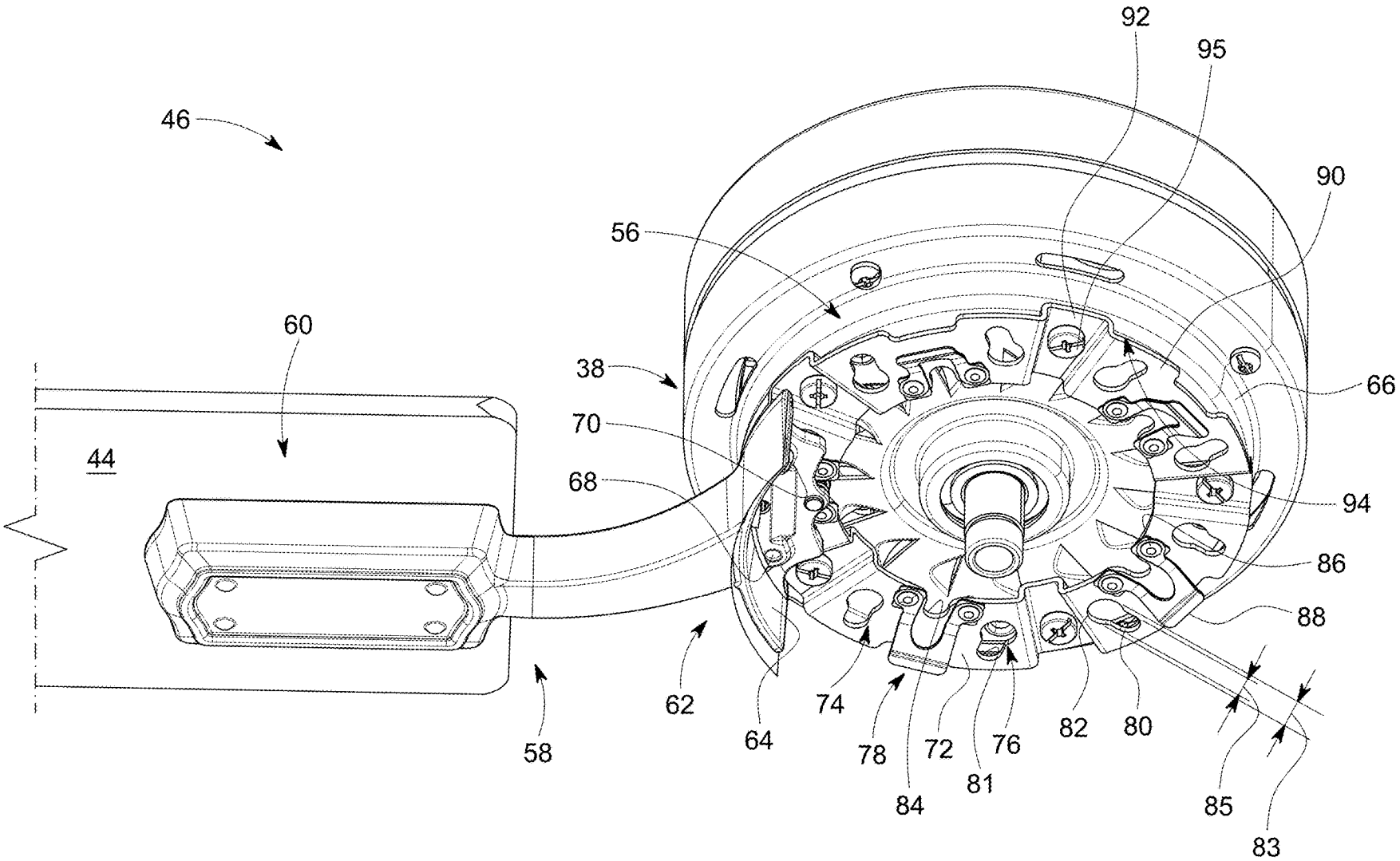
FIG. 2 illustrates the quick connect blade system having a blade iron mount and a blade iron secured to the mount.

Referring to FIG. 2, the quick connect blade system 46 is shown and includes a blade iron mount 56 secured to the rotor 38 and the blade iron 58 secured to the blade iron mount 56. The blade iron 58 extends between a proximal end 60 configured to adjoin to the blade 44, and a distal end 62 configured to mount to the rotor 38. The blade iron 58 includes a connecting portion 64, located at the distal end 62, that connects to the rotor 38 at a bottom end 66 of the rotor 38. The connecting portion 64 can include a pair of studs 68, 70 that can axially extend toward the rotor 38.

The blade iron mount 56 comprises a bracket 72 carried on the rotor 38 that is illustrated in the form of a ring, although the shape is not limited to a ring. The bracket 72 has a pair of spaced slots 74, 76 and a latch spring 78 such that multiple pairs of spaced slots 74, 76 and latch springs 78 are radially arranged about the bracket 72. The pair of spaced slots 74, 76 are a pair of keyhole slots having a receiving slot 80 extending from a slot end 81 and terminating in an insertion hole 82. The insertion hole 82 has a diameter 83 that is greater than a width 85 of the receiving slot 80 measured laterally across the bracket 72. In some examples, as illustrated, a groove or third slot 84 can be formed in the bracket 72 between the pair of spaced slots 74, 76.

The latch spring 78 can be mounted to the bracket 72 in an alternating configuration with the pair of spaced slots 74, 76. That is, the latch spring 78 can be located between the slots in the pair of spaced slots 74, 76. The latch spring 78 has a first end 86 secured to the blade iron mount 56 and a second end 88 located below the blade iron 58. The latch spring 78 is configured to move between an initial, unbiased state, where the latch spring 78 extends downwardly from the first end 86 to the second end 88, and a biased state, where the latch spring 78 is deflected.

The bracket 72 can comprise a first set of radial segments 90 and a second set of radial segments 92. As illustrated, the second set of radial segments 92 are located about the bracket 72 in an alternating configuration with the first set of radial segments 90. The first set of radial segments 90 can be axially spaced from the rotor 38 to define an intervening gap 94 between the first set of radial segments 90 and the bottom end 66 of the rotor 38. At least some of the first set of radial segments 90 can include the pair of spaced slots 74, 76, the latch spring 78, or a combination thereof.

The second set of radial segments 92 abut the rotor 38. The second set of radial segments 92 are secured to the rotor 38 such that a set of fasteners 95 are passed through at least some of the second set of radial segments 92 to couple the bracket 72 to the rotor 38.

Figure 3:
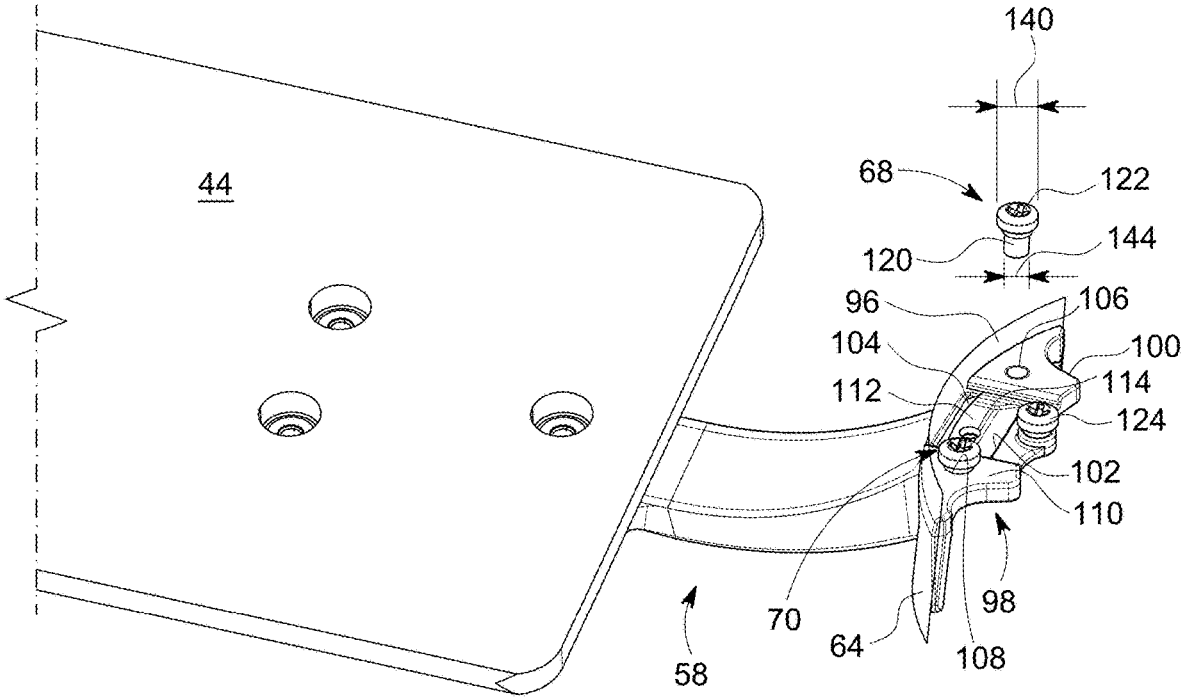
FIG. 3 is a partially exploded perspective view of the blade iron.

Referring to FIG. 3, the relationship between and details of the quick connect blade system 46 are shown and described in greater detail. The connecting portion 64 has a collar 96 and a support ledge 98 radially extending from the collar 96 to enable the mounting of the blade iron 58. The support ledge 98 has a support body 100 defining a spring catch recess 102, an inner band element 104 adjacent to the spring catch recess 102, and a pair of through holes 106, 108 receiving the pair of studs 68, 70.

The spring catch recess 102, as illustrated, is defined in an upper surface 110 of the support body 100 and is located between the pair of through holes 106, 108. The spring catch recess 102 is shaped to conform with a portion of the latch spring 78.

The inner band element 104 is a step shaped portion of the support body 100 that protrudes into and partially defines the spring catch recess 102. As such, the inner band element 104 forms a strike 112 that can confront the latch spring 78 when the connecting portion 64 is initially received by the bracket 72.

A release opening 114, formed in the support body 100, can be coupled to the spring catch recess 102. The release opening 114 is configured to enable a user to release the latch spring 78 from the recess 102.

For illustration purposes, the stud 68 is shown exploded from the through hole 106 and the stud 70 is shown assembled with the through hole 108. It is contemplated that the pair of studs 68, 70 can both be preassembled with through holes 106, 108. The pair of studs 68, 70 are in the form of a shoulder screw having a shank 120 terminating in a head 122. A diameter 140 of the head 122 is less than the diameter 83 of the insertion hole 82 and greater than the width 85 of the receiving slot 80. A diameter 144 of the shank 120 is less than the width 85 of the receiving slot 80.

When the studs 68, 70 are assembled with the through holes 106, 108, the shank 120 extends through the support body 100 such that the head 122 of the shank 120 is spaced from the support body upper surface 110, as illustrated by the stud 70.

The studs 68, 70 assembled with the through holes 106, 108 are configured complementary to an arrangement of the spaced slots 74, 76. In the illustrated example, the support ledge 98 includes a third stud 124 located between the pair of studs 68, 70 that is configured to be receiving into the third slot 84.

Figure 4:
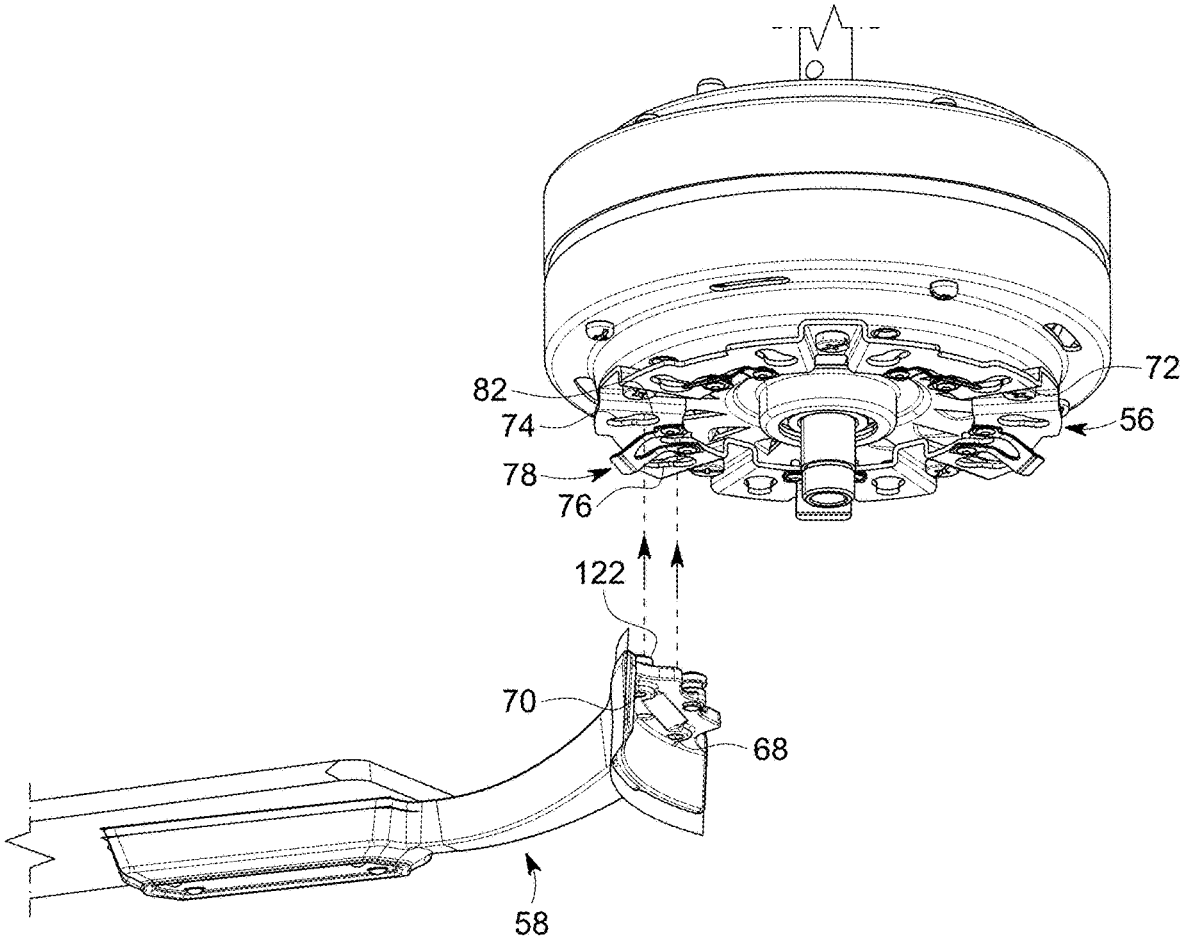
FIG. 4 is an exploded perspective view of the blade iron mount and the blade iron.

Turning now to the mounting of the blade iron 58 to the blade iron mount 56, reference is made to FIG. 4, where, initially, the bracket 72 of the blade iron mount 56, carried by the rotor 38, has the latch spring 78 in an unbiased state. The pair of studs 68, 70 of the blade iron 58 can be received into the pair of spaced slots 74, 76 in the bracket 72 by visually aligning the heads 122 of the studs 68, 70 with the corresponding insertion holes 82. The pair of studs 68, 70 can then be axially guided into the insertion hole 82.

Figure 5:
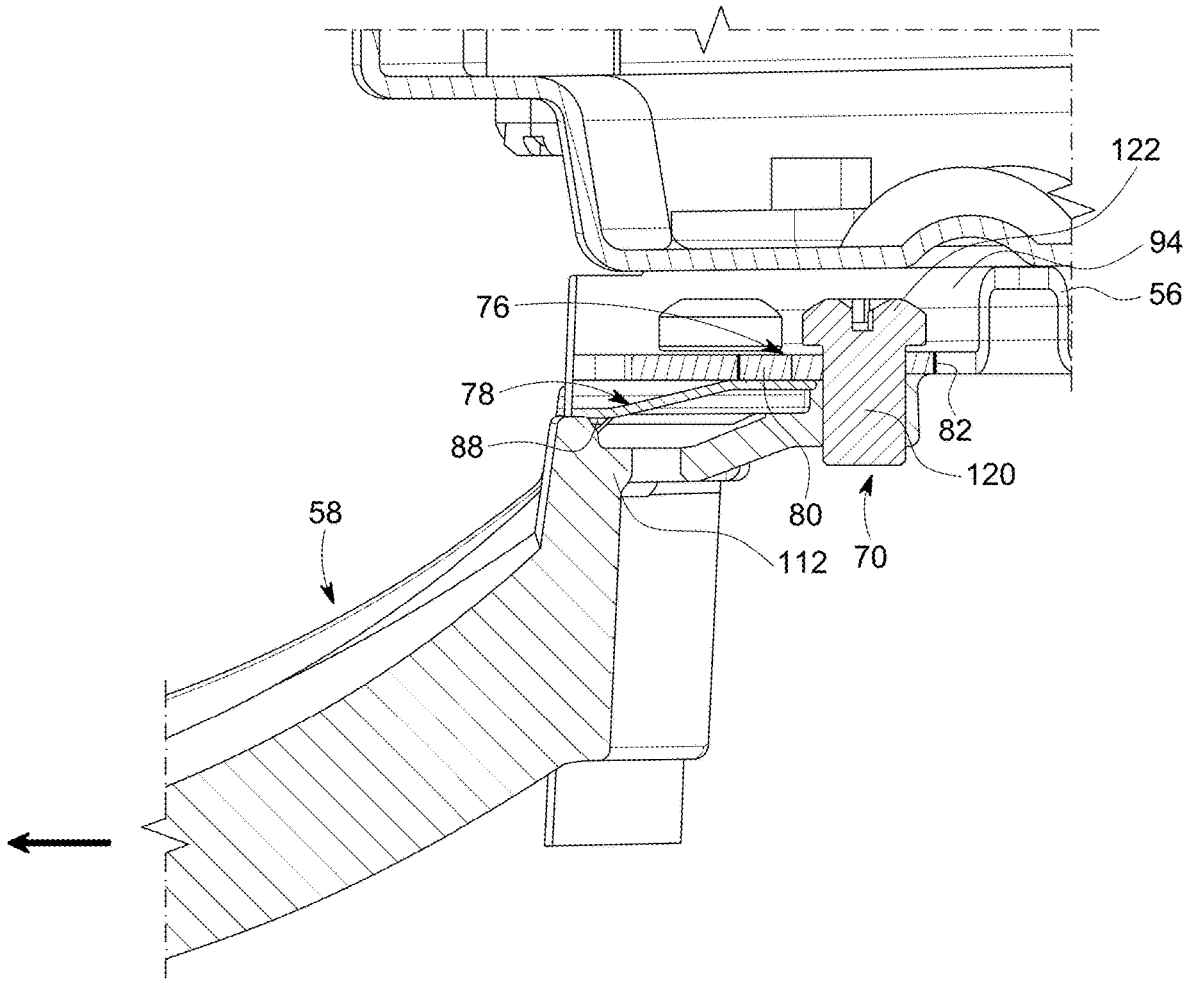
FIG. 5 is a cross-sectional view of the blade iron and blade iron mount in an unlocked position.

FIG. 5 illustrates receipt of the stud 70 in the slot 76 and the latch spring 78 in the biased state. As the studs 68, 70 are passed through the insertion holes 82, the second end 88 of the latch spring 78 catches on a portion of the support body upper surface 110 adjacent to the spring catch recess 102 and deflects the latch spring 78. When the head 122 of the studs 68, 70 are located in the intervening gap 94, a portion of the shank 120 is received in the insertion hole 82 and the studs 68, 70 can then be moved into the receiving slot 80.

Figure 6:
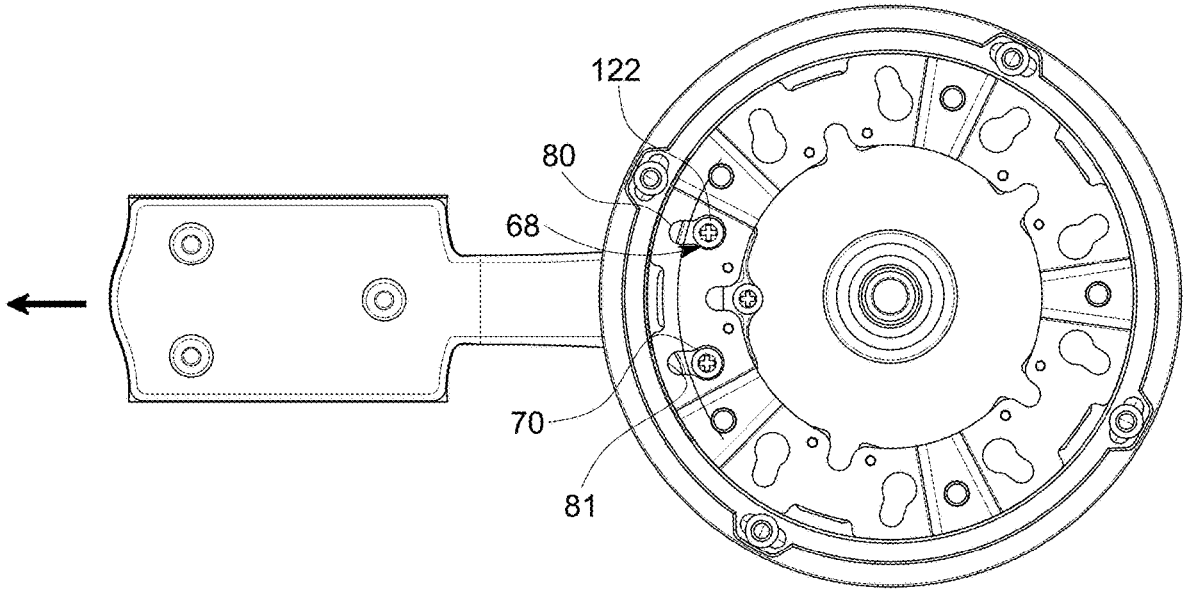
FIG. 6 is a top-down view of the of the blade iron mount and the blade iron in the unlocked position.

Referring to FIG. 6, an alternative view of the studs 68, 70 received the insertion holes 82 is shown. The head 122 is wider than the receiving slot 80 and cannot pass through the receiving slot 80, however, the shank 120 can readily pass through the receiving slot 80 to contact the slot end 81.

Figure 7:
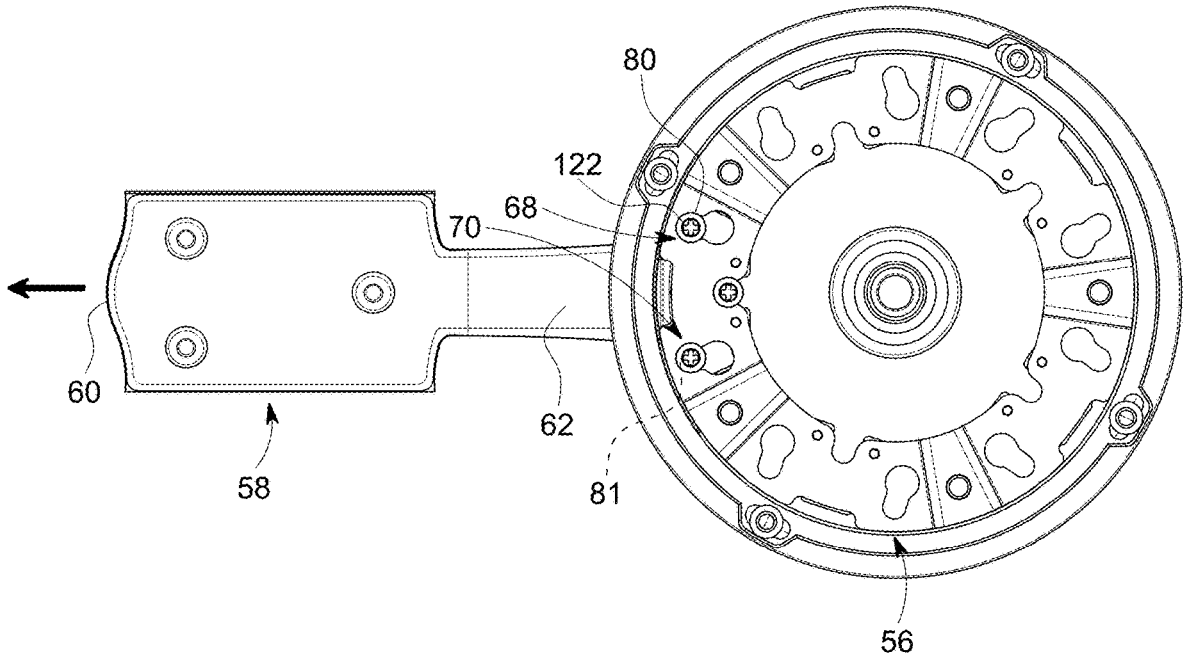
FIG. 7 is a top-down view of the of the blade iron mount and the blade iron in a locked position.

Turning to FIG. 7, the blade iron 58 can be slid radially outward relative to the blade iron mount 56 toward the proximal end 60 of the blade iron 58 (or optionally, the blade iron 58 can be slid radially inward in a direction toward the distal end 62 of the blade iron 58). When the head 122 passes through the insertion slot 82 and a portion of the shank 120 is at the insertion hole 82, the studs 68, 70 can then be moved into the corresponding receiving slot 80 by moving the blade iron 58 radially outward and abutting the shank 120 against the slot end 81 of the receiving slot 80.

Figure 8:
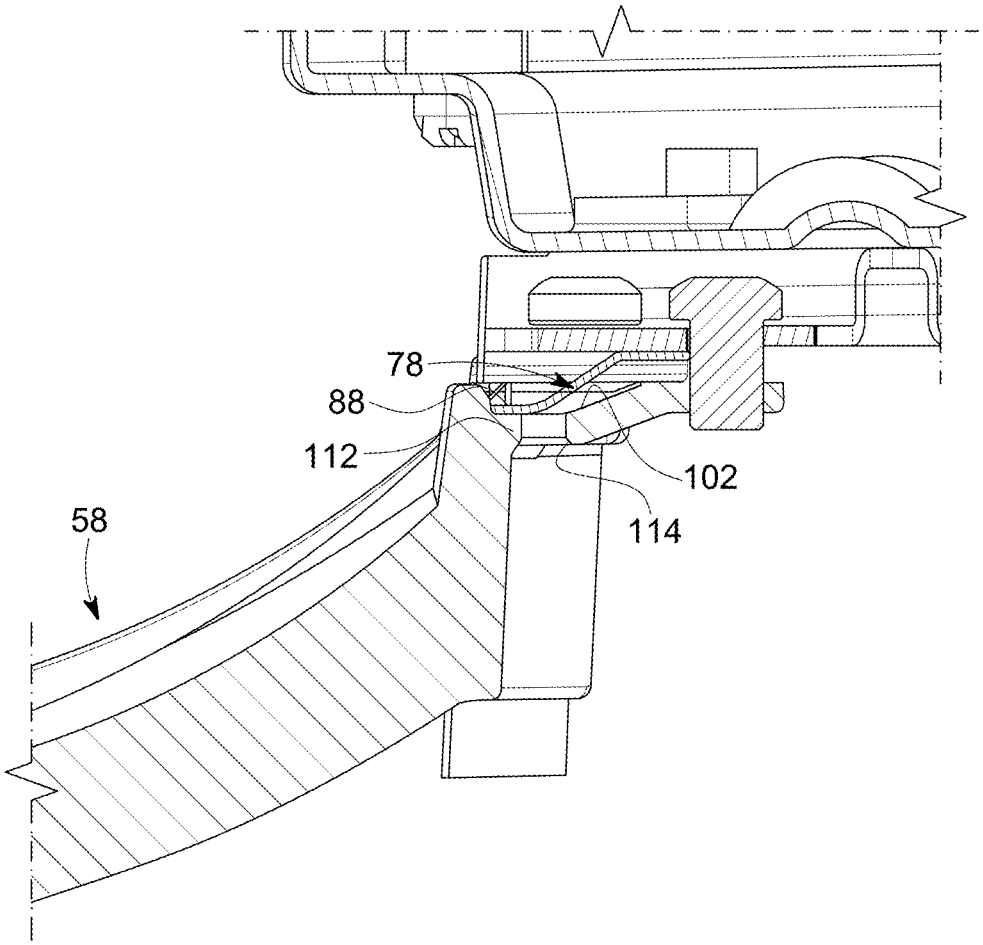
FIG. 8 is a cross-sectional view of the blade iron and blade iron mount in the locked position.

Referring to FIG. 8, the radial sliding of the blade iron 58 eases the deflection of the latch spring 78 by moving the second end 88 of the latch spring 78 into the spring catch recess 102 such that the second end 88 confronts the strike 112. The strike 112 prevents radial inner/outer movement of the blade iron 58, effectively securing the blade iron 58 in a locked position. The latch spring 78 confronting the strike 112 can generate an audible and tactile 'click' or 'snap' that provides tactile feedback to a user during assembly.

To disassemble the blade iron 58 from the blade iron mount 56, the latch spring 78 can be moved out from within the spring catch recess 102 by passing a tool (e.g., screwdriver tip) through the release opening 114 to push against the second end 88 of the latch spring 78 until the second end 88 moves away from the strike 112 and releases from the spring catch recess 102.

The blade iron mount 56, the blade iron 58, and elements thereof as described herein provide for easy and simple connection of the blade iron 58 to a rotor 38 when assembling a blade set to a motor assembly within a ceiling fan. The blade iron mount 56 facilitates installation of the ceiling fan 13, by facilitating installation of the blade irons 58 to the rotor 38, as well as providing visual, audible, and tactile feedback to a user to indicate assembly. Furthermore, the blade iron mount 56 and connected the blade iron 58 can provide for improved resistance to motion, resultant of the snap fit of the latch spring 78 in the spring catch recess 102. Additionally, the release opening 114 of the blade iron 58 facilitates un-installation of the blade irons 58 to the rotor 38 such that a user can readily replace or repair broken parts or otherwise disassemble and reassemble the blade irons 58 to the rotor 38.

Throughout the disclosure, suitable fasteners are described for securing different components. Such fastener can be any type of fastener. In many cases the suitable fastener is a screw or a bolt. If a bolt, then the opening that the bolt is threaded into will be a tapped opening having complementary threads for receipt of the bolt.

While not shown in any of the drawings, a controller can be electrically coupled to a structure S electrical supply to control operation of the ceiling fan assembly 10. Alternatively, the controller can be wirelessly or communicatively coupled to the ceiling fan assembly 10, configured to control operation of the ceiling fan assembly 10 remotely, without a dedicated connection. Non-limiting examples of controls for the ceiling fan assembly 10 can include fan speed, fan direction, or light operation. Furthermore, a separate wireless controller, alone or in addition to the wired controller, can be communicatively coupled to a controller or a wireless receiver in the ceiling fan assembly 10 to control operation. It is further contemplated in one alternative example that the ceiling fan assembly 10 be operated by the wireless controller alone and is not operably coupled with the wired controller.

To the extent not already described, the different features and structures of the various features can be used in combination as desired. That one feature is not illustrated in all of the aspects of the disclosure is not meant to be construed that it cannot be but is done for brevity of description. Thus, the various features of the different aspects described herein can be mixed and matched as desired to form new features or aspects thereof, whether or not the new aspects or features are expressly described. All combinations or permutations of features described herein are covered by this disclosure.

This written description uses examples to detail the aspects described herein, including the best mode, and to enable any person skilled in the art to practice the aspects described herein, including making and using any devices or systems and performing any incorporated methods. The patentable scope of the aspects described herein are defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects are provided by the subject matter of the following clauses:

A ceiling fan comprising: a motor having a rotor; a blade iron mount carried by the rotor and having a pair of spaced slots and a latch spring; a blade iron having a pair of studs, complementary to the spaced slots, and a strike partially defining a spring catch recess; wherein the latch spring, spring catch recess, and strike are arranged such that, after the studs are located in the spaced slots, a radial outer movement of the blade iron deflects the latch spring over the strike, where the latch spring deflects into the spring catch recess and the strike prevents radial inner movement of the blade iron.

The ceiling fan of any preceding clause, wherein the pair of spaced slots comprise a pair of keyhole slots.

The ceiling fan of any preceding clause, wherein the pair of studs comprise a shoulder screw having a shank and a head of greater diameter than the shank.

The ceiling fan of any preceding clause, wherein the keyhole slots comprise a receiving slot terminating in an insertion hole of a diameter greater than a width of the receiving slot, wherein the diameter of the head is less than the insertion hole and greater than the receiving slot, and the shank has a diameter less than the width of the receiving slot.

The ceiling fan of any preceding clause, wherein the latch spring has at least a portion located radially between the pair of slots.

The ceiling fan of any preceding clause, wherein the latch spring has a first end secured to the blade iron mount and a second end located below the blade iron.

The ceiling fan of any preceding clause, wherein the latch spring extends downwardly from the first end to the second end in an unbiased state.

The ceiling fan of any preceding clause, wherein the blade iron comprises an inner band element forming the strike.

The ceiling fan of any preceding clause, wherein the blade iron has a release opening coupled to the spring catch recess, with the release opening located beneath the latch spring.

A ceiling fan comprising: a motor having a rotor; a blade iron mount comprising a bracket, mounted to the rotor, with radially arranged sets of a pair of spaced slots and a latch spring; a blade iron having a pair of studs, each with a shank terminating in a head, complementary to the spaced slots, and a strike partially defining a spring catch recess; wherein the latch spring, spring catch recess, and strike are arranged such that after the shanks are located in the spaced slots, a radial outer movement of the blade iron deflects the latch spring over the strike, where the latch spring deflects into the spring catch recess and the strike prevents radial inner movement of the blade iron.

The ceiling fan of any preceding clause, wherein the bracket comprises a first set of radial segments axially spaced from the rotor to define an intervening gap in which the head is located after the shanks are located in the spaced slots.

The ceiling fan of any preceding clause, wherein the bracket comprises a second set of radial segments, which abut the rotor.

The ceiling fan of any preceding clause, wherein at least some of the second set of radial segments are secured to the rotor.

The ceiling fan of any preceding clause, wherein the first set of radial segments and the second set of radial segments alternate about the bracket.

The ceiling fan of any preceding clause, wherein the pair of spaced slots are a pair of keyhole slots having a receiving slot terminating in an insertion hole.

The ceiling fan of any preceding clause, wherein the insertion hole has a diameter greater than a width of the receiving slot, wherein the diameter of the head is less than the diameter of the insertion hole and greater than the receiving slot, and the shank has a diameter less than the width of the receiving slot.

The ceiling fan of any preceding clause, wherein the latch spring has at least a portion located radially between the pair of slots.

The ceiling fan of any preceding clause, wherein the latch spring has a first end secured to the blade iron mount and a second end located below the blade iron.

The ceiling fan of any preceding clause, wherein the blade iron comprises an inner band element forming the strike.

The ceiling fan of any preceding clause, wherein the blade iron has a release opening coupled to the spring catch recess, with the release opening located beneath the latch spring.

What is claimed is:

1. A ceiling fan comprising:

a motor having a rotor;

a blade iron mount carried by the rotor and having a pair of spaced slots and a latch spring; and a blade iron having a pair of studs, complementary to the spaced slots, and a strike partially defining a spring catch recess;

wherein the latch spring, spring catch recess, and strike are arranged such that, after the studs are located in the spaced slots, a radial outer movement of the blade iron deflects the latch spring over the strike, where the latch spring deflects into the spring catch recess and the strike prevents radial inner movement of the blade iron.

2. The ceiling fan of claim 1, wherein the pair of spaced slots comprise a pair of keyhole slots.

3. The ceiling fan of claim 2, wherein the pair of studs comprise a shoulder screw having a shank and a head of greater diameter than the shank.

4. The ceiling fan of claim 3, wherein the keyhole slots comprise a receiving slot terminating in an insertion hole of a diameter greater than a width of the receiving slot, wherein the diameter of the head is less than the insertion hole and greater than the receiving slot, and the shank has a diameter less than the width of the receiving slot.

5. The ceiling fan of claim 4, wherein the latch spring has at least a portion located radially between the pair of slots.

6. The ceiling fan of claim 5, wherein the latch spring has a first end secured to the blade iron mount and a second end located below the blade iron.

7. The ceiling fan of claim 6, wherein the latch spring extends downwardly from the first end to the second end in an unbiased state.

8. The ceiling fan of claim 1, wherein the blade iron comprises an inner band element forming the strike.

9. The ceiling fan of claim 8, wherein the blade iron has a release opening coupled to the spring catch recess, with the release opening located beneath the latch spring.

10. A ceiling fan comprising:

a motor having a rotor;

a blade iron mount comprising a bracket, mounted to the rotor, with radially arranged sets of a pair of spaced slots and a latch spring; and a blade iron having a pair of studs, each with a shank terminating in a head, complementary to the spaced slots, and a strike partially defining a spring catch recess;

wherein the latch spring, spring catch recess, and strike are arranged such that after the shanks are located in the spaced slots, a radial outer movement of the blade iron deflects the latch spring over the strike, where the latch spring deflects into the spring catch recess and the strike prevents radial inner movement of the blade iron.

11. The ceiling fan of claim 10, wherein the bracket comprises a first set of radial segments axially spaced from the rotor to define an intervening gap in which the head is located after the shanks are located in the spaced slots.

12. The ceiling fan of claim 11, wherein the bracket comprises a second set of radial segments, which abut the rotor.

13. The ceiling fan of claim 12, wherein at least some of the second set of radial segments are secured to the rotor.

14. The ceiling fan of claim 13, wherein the first set of radial segments and the second set of radial segments alternate about the bracket.

15. The ceiling fan of claim 14, wherein the pair of spaced slots are a pair of keyhole slots having a receiving slot terminating in an insertion hole.

16. The ceiling fan of claim 15, wherein the insertion hole has a diameter greater than a width of the receiving slot, wherein the diameter of the head is less than the diameter of the insertion hole and greater than the receiving slot, and the shank has a diameter less than the width of the receiving slot.

17. The ceiling fan of claim 16, wherein the latch spring has at least a portion located radially between the pair of slots.

18. The ceiling fan of claim 17, wherein the latch spring has a first end secured to the blade iron mount and a second end located below the blade iron.

19. The ceiling fan of claim 18, wherein the blade iron comprises an inner band element forming the strike.

20. The ceiling fan of claim 19, wherein the blade iron has a release opening coupled to the spring catch recess, with the release opening located beneath the latch spring.

* * * * *